US009056732B2

(12) United States Patent
Miyamae

(10) Patent No.: US 9,056,732 B2
(45) Date of Patent: Jun. 16, 2015

(54) SHEET FEED APPARATUS AND IMAGE FORMING APPARATUS INCLUDING THE SHEET FEED APPARATUS

(71) Applicant: KYOCERA Document Solutions Inc., Osaka-shi, Osaka (JP)

(72) Inventor: Tsubasa Miyamae, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/495,798

(22) Filed: Sep. 24, 2014

(65) Prior Publication Data

US 2015/0091245 A1 Apr. 2, 2015

(30) Foreign Application Priority Data

Sep. 27, 2013 (JP) ..... 2013-201886

(51) Int. Cl.

*B65H 7/02* (2006.01)
*B65H 1/08* (2006.01)
*B65H 1/18* (2006.01)

(52) U.S. Cl.

CPC .. *B65H 7/02* (2013.01); *B65H 1/08* (2013.01); *B65H 1/18* (2013.01); *B65H 2402/31* (2013.01); *B65H 2405/11162* (2013.01); *B65H 2405/1117* (2013.01); *B65H 2405/1119* (2013.01); *B65H2405/1114* (2013.01); *B65H 2511/152* (2013.01); *B65H 2511/17* (2013.01)

(58) Field of Classification Search

CPC ..... B65H 1/00; B65H 1/08; B65H 1/12; B65H 1/14; B65H 1/18; B65H 1/20; B65H 7/02; B65H 7/14; B65H 2402/31; B65H 2405/10; B65H 2405/1151; B65H 2405/11162; B65H 2405/11163; B65H 2405/1117; B65H 2405/1119; B65H 2511/152; B65H 2511/17; B65H 2553/612; B65H 2601/24; B65H 2405/111; B65H 2405/1111; B65H 2405/1113; B65H 2405/11131; B65H 2405/1114; B65H 2405/11141; B65H 2405/1116

USPC ..... 271/25

See application file for complete search history.

(56) References Cited

U.S. PATENT DOCUMENTS 5,398,108 A * 3/1995 Morinaga et al. ..... 399/381
5,934,667 A * 8/1999 Miki ..... 271/152

(Continued)

FOREIGN PATENT DOCUMENTS

JP 2006298616 A 11/2006
JP 2006327736 A 12/2006

*Primary Examiner* — Jeremy R Severson

(74) *Attorney, Agent, or Firm* — Alleman Hall McCoy Russell & Tuttle LLP

(57) ABSTRACT

A sheet feed apparatus includes a lifting/lowering plate, a drive portion, a determination portion, and a remaining amount detecting portion. The lifting/lowering plate has a sheet mounting surface on which one or more sheets are placed, and is attached to the sheet feed apparatus in such a manner that the sheet mounting surface can be lifted and lowered. The lifting/lowering plate is made of a flexible material. The drive portion drives and lifts and lowers the lifting/lowering plate. The determination portion determines whether or not the lifting/lowering plate has a warpage. The remaining amount detecting portion detects a remaining amount detection value which indicates a remaining amount of sheets placed on the sheet mounting surface. The remaining amount correcting portion corrects the remaining amount detection value detected by the remaining amount detecting portion, based on a determination result of the determination portion.

3 Claims, 8 Drawing Sheets

(56) References Cited

U.S. PATENT DOCUMENTS 8,177,223 B2 * 5/2012 Bauer et al. ..... 271/157
2006/0087070 A1 * 4/2006 Cook et al. ..... 271/145
2009/0295083 A1 * 12/2009 Kitan ..... 271/306
2010/0059929 A1 * 3/2010 Okumura ..... 271/117

* cited by examiner

FIG. 7

| REMAINING AMOUNT DETECTION VALUE(%) | OUTPUT VALUE FROM REMAINING AMOUNT CORRECTING PORTION |
|---|---|
| 0 | 0 |
| 10 | 10 |
| 20 | 10 |
| 30 | 20 |
| 40 | 30 |
| 50 | 50 |
| 60 | 60 |
| 70 | 70 |
| 80 | 80 |
| 90 | 90 |
| 100 | 100 |

SHEET FEED APPARATUS AND IMAGE FORMING APPARATUS INCLUDING THE SHEET FEED APPARATUS

INCORPORATION BY REFERENCE

This application is based upon and claims the benefit of priority from the corresponding Japanese Patent Application No. 2013-201886 filed on Sep. 27, 2013, the entire contents of which are incorporated herein by reference.

BACKGROUND

The present disclosure relates to a sheet feed apparatus for feeding sheets such as paper sheets, and to an image forming apparatus.

Sheet feed apparatuses are broadly adopted in image forming apparatuses such as copiers, facsimiles, scanners, multifunction peripherals, and the like. For example, a sheet feed apparatus is used to automatically feed sheets such as paper sheets one by one, on which the image of the document sheet is transferred and each sheet is conveyed to an image forming apparatus, thereby allowing the image forming apparatus to print each image continuously.

To feed, one by one, a plurality of sheets placed on the tray as a bundle, the sheet feed apparatus causes the sheet bundle to abut a pick-up roller. The thickness of the sheet bundle varies depending on the number of sheets placed on the tray. As a result, it is necessary to cause the sheet bundle to abut the pick-up roller always appropriately. Therefore, in a typical sheet feed apparatus, the distance between the pick-up roller and the sheet mounting surface is adjusted based on the thickness of the sheet bundle. For this adjustment, a lifting/lowering plate (lift plate) may be used, wherein the lifting/lowering plate is attached to the sheet mounting surface in such a manner that the sheet mounting surface can be lifted and lowered. This typical sheet feed apparatus causes the upper surface of the sheet bundle to abut the pick-up roller by causing the lifting/lowering plate to push up the sheet bundle on the lifting/lowering plate. When the pick-up roller abuts a sheet, the pick-up roller feeds the sheet.

There are known various techniques for realizing stable sheet feeding in such a sheet feed apparatus. For example, there is known a configuration in which a torsion spring is adopted as a lift member for lifting the lifting/lowering plate. According to this configuration, the force that pushes up the lift plate is made variable by adjusting the elastic deformation of the torsion spring in correspondence with the paper sheet remaining amount. According to this configuration, an approximately uniform paper feeding pressure (a force that presses the upper surface of the sheet bundle against the pick-up roller) is generated in correspondence with the variation in the weight of the mounted paper sheets.

Furthermore, there is known a configuration in which a plurality of elastic members are used as the lift member for lifting the lifting/lowering plate. According to this configuration, the force that pushes up the lift plate is made variable by using an elastic member that generates a linear elastic force, and an elastic force that generates a non-linear elastic force.

SUMMARY

A sheet feed apparatus according to an aspect of the present disclosure includes a lifting/lowering plate, a drive portion, a determination portion, and a remaining amount detecting portion. The lifting/lowering plate has a sheet mounting surface on which one or more sheets are placed, and is attached to the sheet feed apparatus in such a manner that the sheet mounting surface can be lifted and lowered. The lifting/lowering plate is made of a flexible material. The drive portion drives and lifts and lowers the lifting/lowering plate. The determination portion determines whether or not the lifting/lowering plate has a warpage. The remaining amount detecting portion detects a remaining amount detection value which indicates a remaining amount of sheets placed on the sheet mounting surface. The remaining amount correcting portion corrects the remaining amount detection value detected by the remaining amount detecting portion, based on a determination result of the determination portion.

An image forming apparatus according to another aspect of the present disclosure includes the above-described sheet feed apparatus.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 7 is a diagram showing an example of the remaining amount correction in an embodiment of the present disclosure.

DETAILED DESCRIPTION

The following describes an embodiment of the present disclosure in more detail with reference to the drawings. In the following, the present disclosure is embodied in a digital multifunction peripheral including a sheet feed apparatus.

Figure 1:
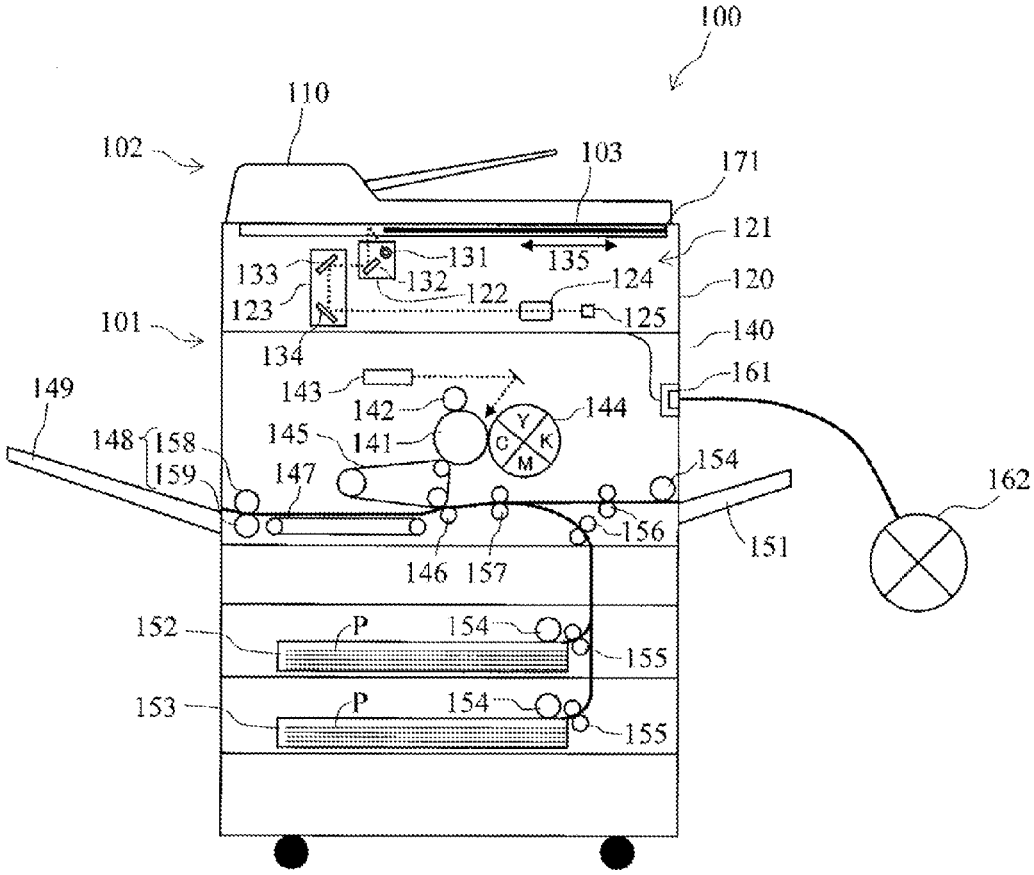
FIG. 1 is an outlined configuration diagram showing the overall configuration of the multifunction peripheral in an embodiment of the present disclosure.

FIG. 1 is an outlined configuration diagram showing an example of the overall configuration of the digital multifunction peripheral in the present embodiment. As shown in FIG. 1, a multifunction peripheral 100 includes a main body 101 and a platen cover 102. The main body 101 includes an image reading portion 120 and an image forming portion 140. The platen cover 102 is attached to the upper part of the main body 101. On the upper surface of the main body 101, a document sheet table 103 is provided. The document sheet table 103 is opened and closed by the platen cover 102. The platen cover 102 includes a document sheet conveying apparatus 110. It is noted that an operation panel 171 is provided on the front surface of the multifunction peripheral 100. With the operation panel 171, users can instruct the multifunction peripheral 100 to start copying or the like and confirm the state or setting of the multifunction peripheral 100.

The image reading portion 120 is provided below the document sheet table 103. The image reading portion 120 causes a scanning optical system 121 to read the image of the document sheet and generates the digital data (image data) of the image. The document sheet is placed on the document sheet table 103 or the document sheet conveying apparatus 110. The scanning optical system 121 includes a first carriage 122, a second carriage 123 and a condensing lens 124. The first carriage 122 includes a linear light source 131 and a mirror 132. The second carriage 123 includes mirrors 133 and 134. The light source 131 irradiates the document sheet with light. The mirrors 132, 133 and 134 guide reflection light from the document sheet into the condensing lens 124, and the condensing lens 124 forms an optical image thereof on a light-receiving surface of a line image sensor 125.

In the scanning optical system 121, the first carriage 122 and the second carriage 123 are provided so as to be able to reciprocate in a sub scanning direction 135. Moving the first carriage 122 and the second carriage 123 in the sub scanning direction 135 makes it possible for the image sensor 125 to read the image of the document sheet placed on the document sheet table 103. To read an image of a document sheet set in the document sheet conveying apparatus 110, the image reading portion 120 fixes the first carriage 122 and the second carriage 123 temporarily to an image reading position, and the image sensor 125 reads the image of the document sheet passing through the image reading position. The image sensor 125 generates image data of the document sheet corresponding to colors R (red), G (green) and B (blue), from the optical image incident on the light-receiving surface. The image forming portion 140 can print an image corresponding to the generated image data onto a paper sheet (a sheet). In addition, the generated image data can be transmitted to other apparatuses (not shown) via a network 162 by a network interface 161.

The image forming portion 140 prints image data onto a paper sheet, wherein the image data may be obtained by the image reading portion 120 or may be received from another apparatus connected to the network 162. The image forming portion 140 includes a photoconductor drum 141. The photoconductor drum 141 rotates at a predetermined speed in a direction. Around the photoconductor drum 141, a charging device 142, an exposing device 143, a developing device 144, and an intermediate transfer belt 145 are disposed in order from the upstream side in the rotation direction. The charging device 142 charges the surface of the photoconductor drum 141 uniformly. The exposing device 143 forms an electrostatic latent image on the photoconductor drum 141 by irradiating a light beam on the uniformly charged surface of the photoconductor drum 141 based on the image data. The developing device 144 forms a toner image on the photoconductor drum 141 by causing the toner to be adhered to the electrostatic latent image. The intermediate transfer belt 145 transfers the toner image on the photoconductor drum 141 onto a paper sheet. When the image data is a color image, the intermediate transfer belt 145 transfers toner images of different colors onto the same paper sheet. It is noted that color images of the RGB format are converted into image data of C (cyan), M (magenta), Y (yellow) and K (black), and the image data of these colors are input to the exposing device 143.

The image forming portion 140 feeds paper sheets one by one from a manual feed tray 151 and paper-sheet feed apparatuses (sheet feed apparatuses) 152, 153 and the like to a transfer portion between the intermediate transfer belt 145 and a transfer roller 146. Paper sheets of various sizes may be placed or housed in the manual feed tray 151 and the paper-sheet feed apparatus 152, 153. The image forming portion 140 selects a paper sheet based on a specification by the user or a paper sheet that corresponds to an automatically detected size of the document, and causes a pick-up roller 154 to feed the selected paper sheet from the manual feed tray 151 or the paper-sheet feed apparatus 152, 153. The paper sheet thus fed is conveyed by a conveying roller 155, 156 or a resist roller 157 to the transfer portion. A toner image is transferred onto the paper sheet, and the paper sheet is conveyed by a conveyance belt 147 to a fixing device 148. The fixing device 148 includes a fixing roller 158 and a pressure roller 159. The fixing roller 158 includes a heater. The fixing device 148 fixes the toner image onto the paper sheet by heat and the pressure force. The image forming portion 140 discharges a paper sheet having passed through the fixing device 148 into a paper sheet discharge tray 149.

Figure 2A:
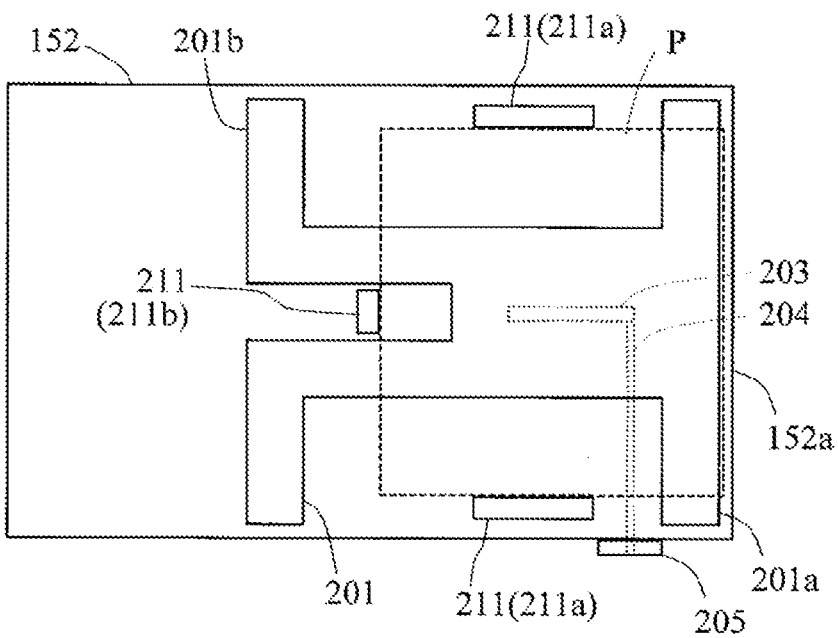
FIGS. 2A through 2C are schematic diagrams showing the paper-sheet feed apparatus included in the multifunction peripheral of an embodiment of the present disclosure.
Figure 2B:
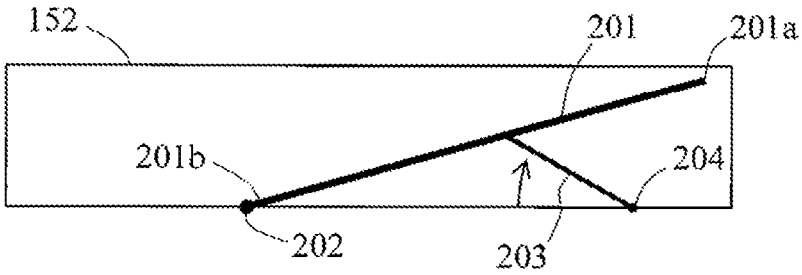
Figure 2C:
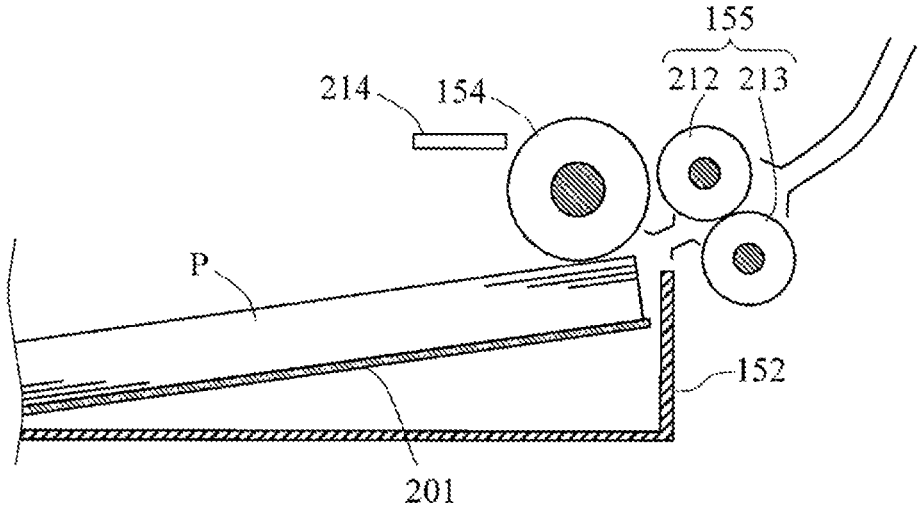

The following describes the configuration of the paper-sheet feed apparatus 152, 153 based on the paper-sheet feed apparatus 152. The paper-sheet feed apparatus 152 is configured to house paper sheets P (also referred to as "paper bundle" as appropriate). The paper bundle is stacked on a lifting/lowering plate 201 which is provided in the paper-sheet feed apparatus 152 and can be lifted and lowered. FIGS. 2A through 2C show the paper-sheet feed apparatus 152. FIG. 2A is an outlined plan view of a paper-sheet housing portion (cassette portion) included in the paper-sheet feed apparatus 152. FIG. 2B is a schematic diagram showing a lifting/lowering mechanism (drive portion) for the lifting/lowering plate of the paper-sheet feed apparatus 152. FIG. 2C is an enlarged view showing the configuration of the peripheral of the pick-up roller 154 of the paper-sheet feed apparatus 152 in which the paper bundle P has been housed.

As shown in FIG. 2C, the paper bundle P is placed on the upper surface (sheet mounting surface) of the lifting/lowering plate 201. As shown in FIG. 2A, the lifting/lowering plate 201, on which the paper bundle P is placed, is disposed in a bottom part on the paper sheet conveying side of the paper-sheet feed apparatus 152. That is, the lifting/lowering plate 201 is disposed in a state where a paper-sheet conveying-side end 201*a* of the lifting/lowering plate 201 is close to a paper-sheet conveying-side end 152*a* of the paper-sheet feed apparatus 152. The lifting/lowering plate 201 is disposed to extend approximately the whole width of the paper-sheet feed apparatus 152 in the width direction (a direction perpendicular to the paper-sheet conveying direction). In addition, the lifting/lowering plate 201 is disposed to extend a predetermined distance (for example, approximately ⅔ of the whole length of the paper-sheet feed apparatus 152 in the length direction, i.e., the paper-sheet conveying direction) from the pick-up roller 154 side of the bottom part of the paper-sheet feed apparatus 152.

The paper-sheet feed apparatus 152 includes paper-sheet guides 211 that are movable and prevent movement of the paper sheets P placed on the upper surface of the lifting/lowering plate 201. In the example shown in FIG. 2A, the paper-sheet guides 211 are composed of a pair of paper-sheet guides 211*a* and a paper-sheet guide 211*b*. The pair of paper-sheet guides 211*a* are disposed to be movable along the width direction of the paper-sheet feed apparatus 152. The paper-sheet guide 211*b* is disposed to face the paper-sheet conveying-side end 152*a* of the paper-sheet feed apparatus 152 and be movable along the length direction of the paper-sheet feed apparatus 152. The lifting/lowering plate 201 has cuts in correspondence with the movable range of the paper-sheet guides 211. The cuts are provided so that the paper-sheet guides 211 do not interfere with the lifting/lowering plate 201 when the paper-sheet guides 211 are moved based on the size of the paper sheet that can be placed on the upper surface of the lifting/lowering plate 201. The lifting/lowering plate 201 is formed from a material that is flexible. In the present embodiment, the lifting/lowering plate 201 is made of a plastic resin (resin-made member).

As shown in FIGS. 2A and 2B, the paper-sheet conveying-side end 201*a* of the lifting/lowering plate 201 is a free end that can be lifted and lowered (hereinafter the end 201*a* is referred to as "free end 201*a*"). An end 201*b* opposite to the paper-sheet conveying-side end 201*a* is a support end (hereinafter, the end 201*b* is referred to as "support end 201*b*"). The support end 201*b* is supported by a rotational shaft 202. The rotational shaft 202 is disposed in the bottom surface of the paper-sheet feed apparatus 152 to extend along the width direction of the paper-sheet feed apparatus 152. The lifting and lowering of the lifting/lowering plate 201 is realized by a lifting/lowering plate elevating shaft (drive portion) 203. The lifting/lowering plate elevating shaft 203 is disposed under the lifting/lowering plate 201 in the state where an end thereof abuts the lifting/lowering plate 201. The lifting/lowering plate elevating shaft 203 is disposed at the center of the paper-sheet feed apparatus 152 in the width direction. The other end of the lifting/lowering plate elevating shaft 203 is supported by a rotational shaft 204. The rotational shaft 204 is disposed in the bottom surface of the paper-sheet feed apparatus 152 to extend along the width direction of the paper-sheet feed apparatus 152. The lifting/lowering plate elevating shaft 203 rises with respect to the bottom of the paper-sheet feed apparatus 152 as the rotational shaft 204 rotates in the direction indicated by the arrow in FIG. 2B. This causes the free end 201*a* of the lifting/lowering plate 201 to be lifted. It is noted that an arbitrary known configuration can be used for the drive mechanism of the rotational shaft 204. For example, it is possible to adopt a configuration where the rotational shaft 204 is connected with a group of gears 205 disposed on a side of the paper-sheet feed apparatus 152. According to this configuration, when the paper-sheet feed apparatus 152 is attached to the multifunction peripheral 100, the group of gears 205 mesh with a gear coupled with the rotational shaft of the motor of the multifunction peripheral 100 side. As a result, the rotational force of the rotational shaft of the motor of the multifunction peripheral 100 side can be transmitted to the rotational shaft 204.

With the above-described configuration, as shown in FIG. 2C, the paper bundle P placed on the upper surface of the lifting/lowering plate 201 is lifted as the lifting/lowering plate elevating shaft 203 is rotated. Subsequently, the uppermost paper sheet in the paper bundle P abuts the pick-up roller 154. The pick-up roller 154, which is supported to be freely movable in the up-down direction, is moved upward upon abutting the paper bundle P. It is possible to detect the abutting of the pick-up roller 154 with the paper sheets by causing a sensor 214 such as an optical sensor or the like to detect the above-mentioned upward movement. When the uppermost paper sheet abuts the pick-up roller 154, the rotation of the lifting/lowering plate elevating shaft 203 is stopped. At this time, the motor is set to the locked state so as to fix the lifting/lowering plate 201 in position. In this state, the pick-up roller 154 sends the abutting paper sheet toward the downstream side.

As shown in FIG. 2C, a conveying rollers 155 are disposed on the downstream side of the pick-up roller 154. The conveying rollers 155 are composed of a conveyance roller 212 and a separation roller 213. Even if two or more paper sheets are picked up by the pick-up roller 154, the first paper sheet among them is separated and conveyed toward the downstream side by the conveyance roller 212 and the separation roller 213.

Meanwhile, in a typical image forming apparatus such as a printer, it is required to improve the image formation speed (printing speed). As a result, in the multifunction peripheral 100 too, the rotational speed (linear velocity) of the pick-up roller 154 has been increased to improve the paper sheet supply speed of the paper-sheet feed apparatus 152. With an increase in the rotational speed of the pick-up roller 154, a friction force increases as well, wherein the friction force occurs between the pick-up roller 154 and the uppermost paper sheet in the paper bundle P when the pick-up roller 154 starts to rotate.

On the other hand, there is a demand for the image forming apparatus to be low in price. As a result, to meet the demand, in the multifunction peripheral 100 too, an attempt has been made to reduce the cost for the members constituting the multifunction peripheral 100. To reduce the cost, some members made of metals have been replaced with those made of resin such as plastic. Specifically, as described above, the lifting/lowering plate 201 is made of plastic resin.

However, when a member made of resin such as plastic resin is adopted in the lifting/lowering plate 201 of the paper-sheet feed apparatus 152 in which the pick-up roller 154 has a high linear velocity, the lifting/lowering plate 201 is warped by the above-mentioned friction force. When a warpage occurs to the lifting/lowering plate 201, the force that presses the paper bundle P against the pick-up roller 154 is reduced. As a result, the paper feeding pressure (the force that presses the upper surface of the paper bundle P against the pick-up roller 154) is reduced, and it becomes impossible to feed the paper sheet appropriately.

Figure 3A:
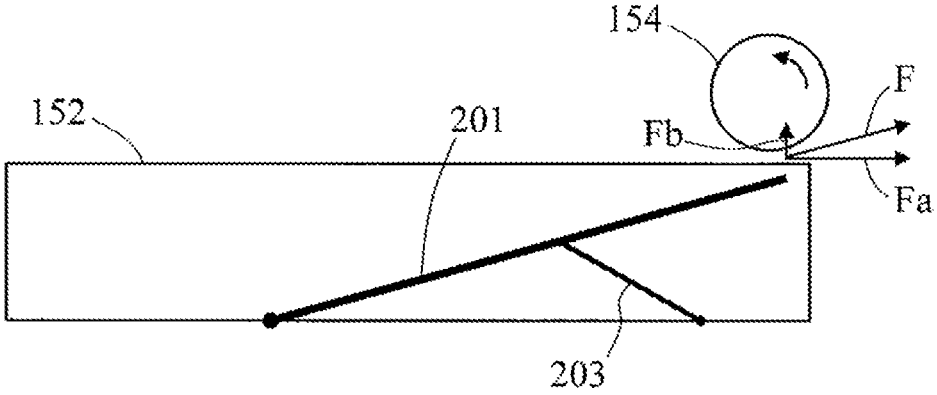
FIGS. 3A through 3C are schematic diagrams showing the occurrence factor of the warpage of the lifting/lowering plate included in the multifunction peripheral of an embodiment of the present disclosure.
Figure 3B:
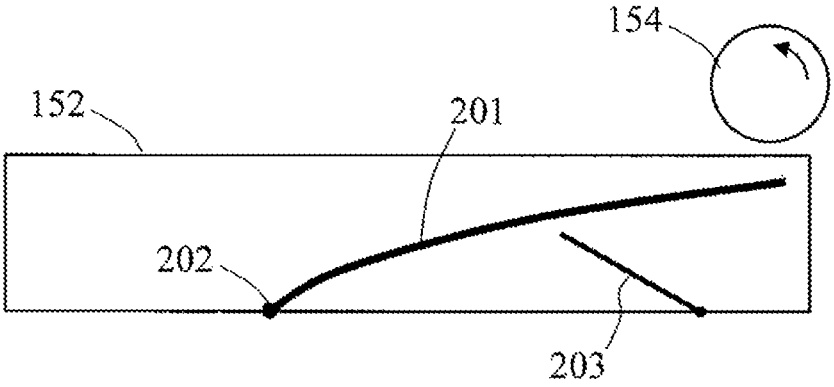
Figure 3C:
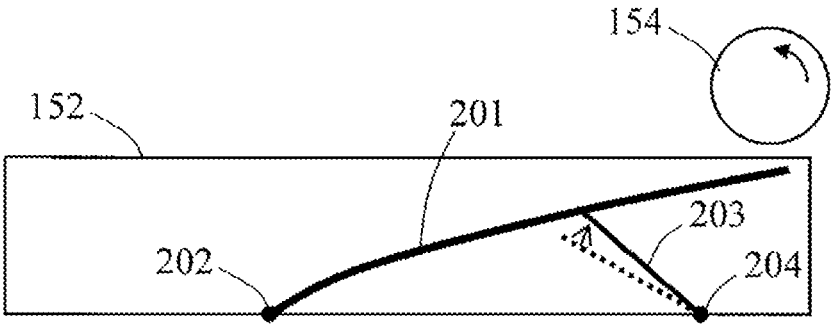

As described above, a warpage occurs to the lifting/lowering plate 201 when the pick-up roller 154 has a high linear velocity and the lifting/lowering plate 201 is flexible. FIGS. 3A through 3C are schematic diagrams showing the occurrence factor of the warpage of the lifting/lowering plate 201.

As shown in FIG. 3A, when the pick-up roller 154 starts to be driven in the state where it is abutting the uppermost paper sheet, the friction force allows a force F to occur in a direction parallel to the lifting/lowering plate 201. The force F can be resolved into a force Fa of a horizontal-direction component and a force Fb of a vertical-direction component. That is, the force Fa of the horizontal-direction component along the paper-sheet conveying direction acts on the lifting/lowering plate 201. As shown in FIG. 2A, in the present embodiment, the support end 201*b* of the lifting/lowering plate 201 is fixed, and there are cuts between the support end 201*b* and the free end 201*a*. In this configuration, when the force Fa acts, a warpage may occur in a portion near the support end 201*b* where the lifting/lowering plate 201 has a small width due to the cuts, as shown in FIG. 3B.

Meanwhile, as described below, in the paper-sheet feed apparatus 152, the remaining amount of the paper bundle P on the lifting/lowering plate 201 (sheet remaining amount) is detected. The detected remaining amount is notified to the user via, for example, the operation panel 171 of the multifunction peripheral 100. This allows for the user to confirm, before starting a print work, whether or not the amount of paper sheets P is sufficient for the print work. If the amount of paper sheets P is not sufficient for the print work, the user can supplement the paper sheets P in advance. Such a detection of the remaining amount of paper sheets (paper sheet remaining amount detection) is realized by detecting, directly or indirectly, the position of the upper surface of the paper bundle P or the position of the lifting/lowering plate 201. The above-mentioned warpage of the lifting/lowering plate 201 causes a detection error to occur in the paper sheet remaining amount detection as described below.

The easiness of the occurrence of the warpage depends on the amount of paper bundle P placed on the lifting/lowering plate 201. When the amount of paper bundle P is large, it tends to be difficult for the warpage to occur. When the amount of paper bundle P is small, the warpage tends to occur easily. Furthermore, when the amount of paper bundle P is extremely small, it is difficult for the warpage to occur.

When a warpage occurs to the lifting/lowering plate 201, the position of the free end 201*a* of the lifting/lowering plate 201 moves downward, and the friction force between the paper bundle P and the pick-up roller 154 is reduced. In addition, with an occurrence of a warpage, a gap may be generated between the lifting/lowering plate 201 and the lifting/lowering plate elevating shaft 203. When such a gap is generated, the abutting of the pick-up roller 154 with the paper bundle P may not be detected by the sensor 214. In that case, as shown in FIG. 3C, the lifting/lowering plate elevating shaft 203 is driven until the abutting of the pick-up roller 154 with the paper bundle P is detected by the sensor 214.

Figure 4:
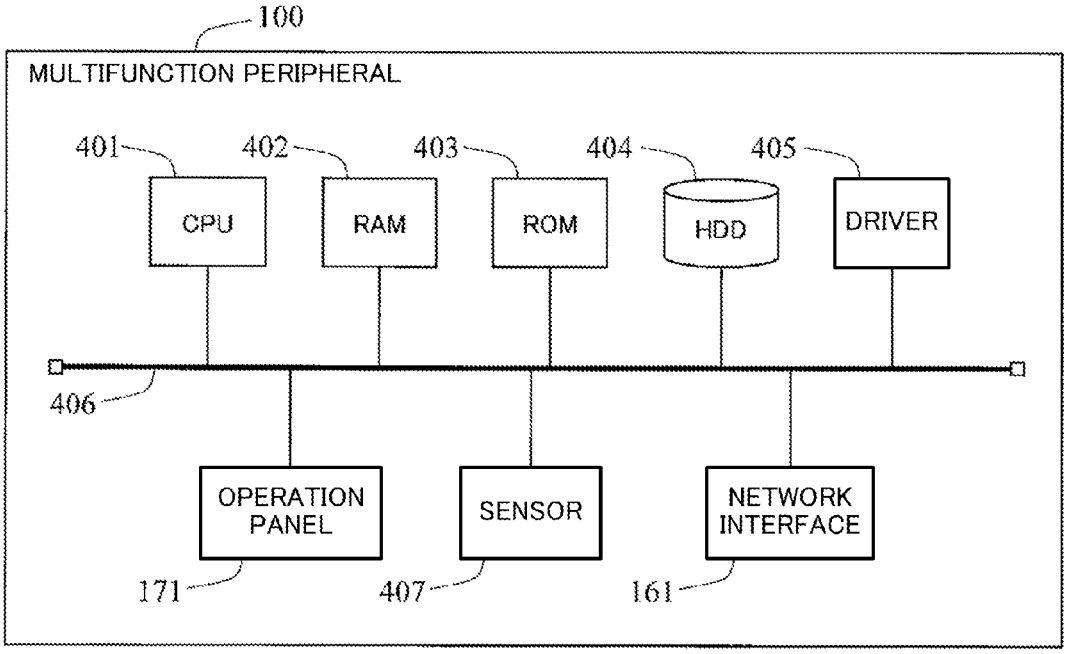
FIG. 4 is a diagram showing a hardware configuration of the multifunction peripheral in an embodiment of the present disclosure.

FIG. 4 is a hardware configuration diagram of a control system in the multifunction peripheral. In the multifunction peripheral 100 of the present embodiment, a CPU 401, a RAM 402, a ROM 403, an HDD 404, and a driver 405 are connected via an internal bus 406, wherein the driver 405 corresponds to each drive portion in the document sheet conveying apparatus 110, image reading portion 120, and image forming portion 140. The ROM 403, HDD 404 and the like store programs. The CPU 401 controls the multifunction peripheral 100 based on the instructions from tho control programs. For example, the CPU 401 uses the RAM 402 as a work area, and controls the operation of the above-mentioned each drive portion by sending and receiving data and instructions to/from the driver 405. In addition, the HDD 404 is used to accumulate image data obtained by the image reading portion 120 and image data received from external apparatuses via the network interface 161.

To the internal bus 406, the operation panel 171 and various types of sensors 407 are connected, as well. The operation panel 171 receives a user operation and supplies a signal to the CPU 401 based on the received user operation. The operation panel 171 further displays an operation screen on a display provided therein, based on a control signal from the CPU 401. The sensors 407 include various types of sensors such as an opening/closing sensor for sensing the opening/closing of the platen cover 102, a document-sheet sensor for sensing a document sheet on the document sheet table 103, a temperature sensor for sensing the temperature of the fixing device 148, a sensor for sensing a paper sheet or document sheet being conveyed, or the like. The CPU 401 realizes a plurality of means (functional blocks) described below by executing, for example, the programs stored in the ROM 403, and controls the operation of the means based on the signals from these sensors.

Figure 5:
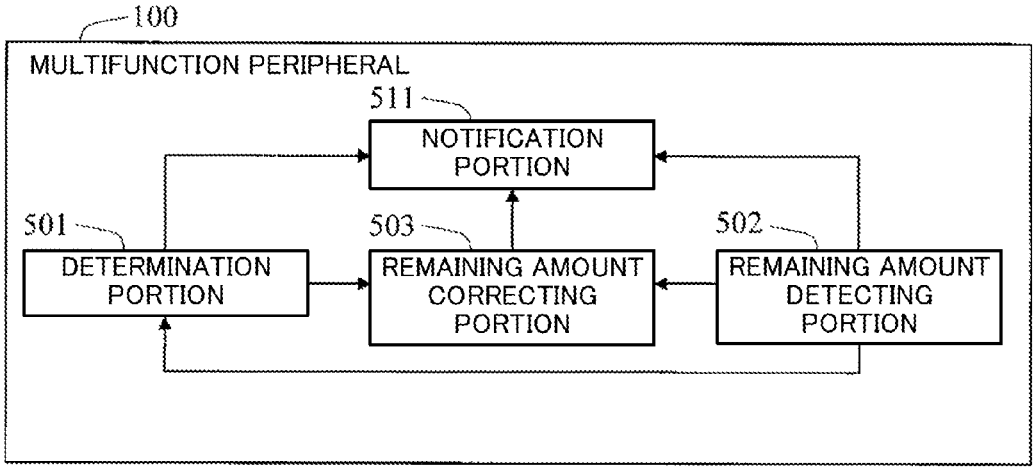
FIG. 5 is a functional block diagram showing the multifunction peripheral in an embodiment of the present disclosure.

FIG. 5 is a functional block diagram of the printing system of the present embodiment. As shown in FIG. 5, the multifunction peripheral 100 of the present embodiment includes a determination portion 501, a remaining amount detecting portion 502, and a remaining amount correcting portion 503.

The determination portion 501 determines whether or not the lifting/lowering plate 201 has a warpage. Although not limited in particular, in the present embodiment, the determination portion 501 determines whether or not the lifting/lowering plate 201 has a warpage, based on the amount of paper sheets placed on the lifting/lowering plate 201. As described above, a warpage occurs to the lifting/lowering plate 201 when paper sheets of an amount belonging to a predetermined range, within the range of amount of paper sheets that can be placed, are placed. As a result, in the present embodiment, the correspondence relation between the amount of paper bundle P placed on the lifting/lowering plate 201 and whether or not a warpage occurs to the lifting/lowering plate 201 is obtained in advance, and the correspondence relation is registered in the determination portion 501. The amount of paper bundle P placed on the lifting/lowering plate 201 is obtained by the remaining amount detecting portion 502 as described below. With this configuration, the determination portion 501 determines whether or not the lifting/lowering plate 201 has a warpage based on the correspondence relation and the amount of paper sheets placed on the lifting/lowering plate 201. Specifically, in the present embodiment, when the paper sheet remaining amount detected by the remaining amount detecting portion 502 belongs to the predetermined range, the determination portion 501 determines that a warpage has occurred to the lifting/lowering plate 201. Although not limited in particular, for example, such a correspondence relation can be obtained in advance during the manufacturing process of the multifunction peripheral 100 and be registered in the determination portion 501.

It is noted that the determination portion 501 may use other arbitrary methods to determine whether or not the lifting/lowering plate 201 has a warpage. For example, it is possible to adopt a configuration where a sensor or the like is used to directly detect whether or not the lifting/lowering plate 201 has a warpage.

The remaining amount detecting portion 502 detects the remaining amount of the paper sheets (sheets) placed on the upper surface (sheet mounting surface) of the lifting/lowering plate 201. The remaining amount detecting portion 502 may adopt an arbitrary known configuration. For example, the remaining amount detecting portion 502 may determine the paper sheet remaining amount based on the position of the lifting/lowering plate 201, the amount of lift, the position of the uppermost paper sheet, or the like. To detect these positions, an optical sensor such as a photoreflector or a photointerrupter or other non-contact-type sensor, or a contact-type sensor such as a microswitch may be used.

Figure 6A:
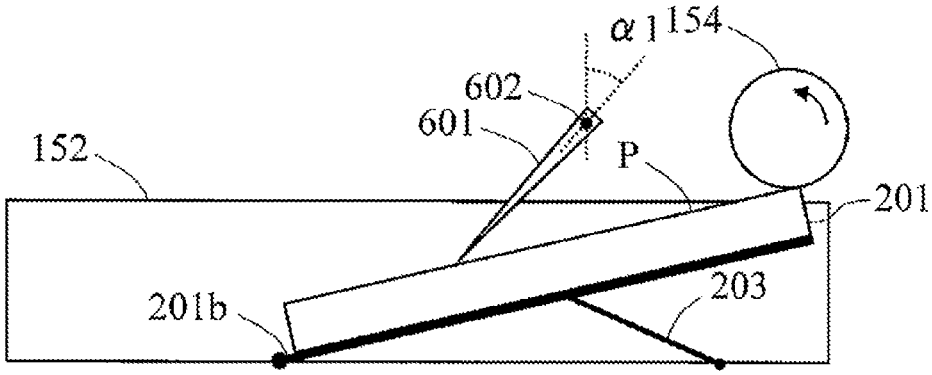
FIGS. 6A through 6C are diagrams showing an example of the remaining amount detection method in an embodiment of the present disclosure
Figure 6B:
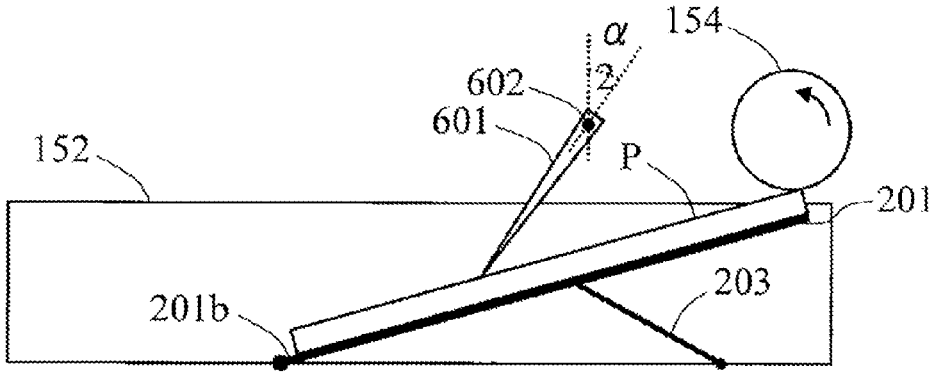
Figure 6C:
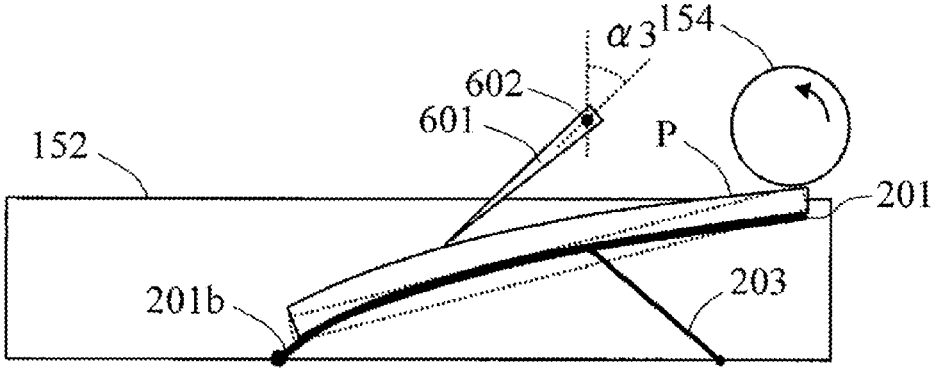

Although not limited in particular, in the present embodiment, as shown in FIGS. 6A through 6C, the remaining amount detecting portion 502 adopts a configuration where it detects the amount of paper bundle P by the angle of an abutting member 601 that abuts the uppermost paper sheet in the paper bundle P.

In this example, the abutting member 601 is composed of a bar-like member whose front end, which abuts the uppermost paper sheet in the paper bundle P, is thinner than the base end. As shown in FIGS. 6A through 6C, the base end of the abutting member 601 is rotatably supported by a rotational shaft 602 that extends along the width direction of the paper-sheet feed apparatus 152. The abutting member 601 is disposed at a position which is more on the support end 201*b* side than the center of the lifting/lowering plate 201 in the length direction of the paper-sheet feed apparatus 152, and faces the paper sheets placed on the lifting/lowering plate 201. It is noted that the position at which the abutting member 601 is disposed may be any position as far as the position faces paper sheets of all sizes that can be housed in the paper-sheet feed apparatus 152. It is also noted that the abutting member 601 has a mechanism that causes the abutting member 601 to retreat to an upper position from a predetermined position above the paper bundle P when the paper-sheet feed apparatus 152 is detached from the multifunction peripheral 100, and causes the abutting member 601 to be placed at the predetermined position above the paper bundle P when the paper-sheet feed apparatus 152 is attached to the multifunction peripheral 100.

According to this configuration, the remaining amount detecting portion 502 measures the angle of the abutting member 601 in the state where the lifting/lowering plate 201 is lifted and the uppermost paper sheet in the paper bundle P is abutting the pick-up roller 154. Such an angle may be obtained as an angle that is made by, for example, an arbitrary reference plane (for example, a vertical plane including the rotational shaft 602) and the abutting member 601. The angle may be detected as, for example, a rotational angle of the rotational shaft 602. The rotational angle of the rotational shaft 602 may be measured by, for example, a rotary encoder. It is noted that, as described above, the abutting of the uppermost paper sheet in the paper bundle P with the pick-up roller 154 may be detected by the sensor 214.

According to the lifting/lowering plate 201 of the present embodiment, the free end 201*a* is lifted or lowered while the support end 201*b* is fixed. As a result, the angle made by the uppermost paper sheet in the paper bundle P and a horizontal plane varies depending on the position of the lifting/lowering plate 201 (the angle made by the lifting/lowering plate 201 and the horizontal plane). In that case, the angle of the abutting member 601, which is abutting the uppermost paper sheet in the paper bundle P while the uppermost paper sheet is abutting the pick-up roller 154, varies depending on the amount of paper bundle P. Here, a relation $\alpha 1 > \alpha 2$ is satisfied, wherein $\alpha 1$ represents an angle made by the abutting member 601 and a vertical plane including the rotational shaft 602 in the state where, as shown in FIG. 6A, the amount of paper bundle P is relatively large, and $\alpha 2$ represents an angle made by the abutting member 601 and the vertical plane including the rotational shaft 602 in the state where, as shown in FIG. 6B, the amount of paper bundle P is relatively small. That is, according to this configuration, the smaller the amount of paper bundle P placed on the lifting/lowering plate 201 is, the smaller the angle made by the abutting member 601 and the vertical plane including the rotational shaft 602 is. It is thus possible to grasp the amount of paper bundle P placed on the lifting/lowering plate 201, by measuring the angle of the abutting member 601. It is noted that the angle of the abutting member 601 may desirably be measured immediately after completion of a lift of the lifting/lowering plate 201.

Meanwhile, as described above, in the case where the lifting/lowering plate 201 made of resin is adopted, when a warpage occurs to the lifting/lowering plate 201, the paper bundle P placed on the upper surface of the lifting/lowering plate 201 is warped along the lifting/lowering plate 201 as well. The position of the uppermost paper sheet in the paper bundle P and the position of the lifting/lowering plate 201 in the case where a warpage has occurred are different from those in the case where no warpage has occurred. As a result, even if the same amount of paper bundle P is placed, the remaining amount of paper sheets P (sheet remaining amount) detected in the case where a warpage has occurred is different from the remaining amount of paper sheets P detected in the case where no warpage has occurred. That is, a detection error occurs in the paper sheet remaining amount detection. When such a remaining amount detection error occurs, the above-mentioned paper feeding pressure to the pick-up roller 154 may not be maintained constant. On the other hand, as described above, the paper-sheet feed apparatus 152 of the present disclosure is configured to prevent an occurrence of a detection error due to a warpage of the lifting/lowering plate 201 in detecting the remaining amount of paper sheets P.

FIG. 6C is a schematic diagram for explaining the remaining amount detection error that may occur due to a warpage of the lifting/lowering plate 201 in the case where the above-described remaining amount detection method is adopted. It is noted that in FIG. 6C, the warpage is highlighted in particular.

As shown in FIG. 6C, when a warpage occurs to the lifting/lowering plate 201, the paper bundle P placed on the lifting/lowering plate 201 is also warped along the warpage of the lifting/lowering plate 201. At this time, the position of the uppermost paper sheet in the paper bundle P moves upward. As a result, an angle $\alpha 3$ made by the abutting member 601 and the vertical plane including the rotational shaft 602 in this state is larger than the angle $\alpha 2$ in the state where no warpage has occurred to the lifting/lowering plate 201. As a result, as the paper sheet remaining amount, an amount larger than the actual paper sheet remaining amount is detected.

As understood from FIG. 6C, the amount of upward movement of the uppermost paper sheet in the paper bundle P due to the warpage of the lifting/lowering plate 201 varies depending on the position of the abutting member 601 with respect to the paper bundle P. For example, in the vicinity of the pick-up roller 154, or in the vicinity of the support end 201*b* of the lifting/lowering plate 201, the amount of upward movement of the uppermost paper sheet in the paper bundle P due to the warpage of the lifting/lowering plate 201 is small. However, it is difficult to dispose a mechanism such as the abutting member 601 in the vicinity of the pick-up roller 154 because only a small spacial allowance exists. In addition, in the vicinity of the support end 201*b* of the lifting/lowering plate 201, when paper sheets of a small size are placed on the lifting/lowering plate 201, the abutting member 601 may not abut the paper bundle P. As a result, in many cases, the abutting member 601 needs to be disposed at a position where the amount of upward movement of the uppermost paper sheet in the paper bundle P due to the warpage of the lifting/lowering plate 201 is relatively large.

The remaining amount correcting portion 503 corrects the remaining amount of paper sheets detected by the remaining amount detecting portion 502, based on the determination result of the determination portion 501. Although not limited in particular, the remaining amount correcting portion 503 corrects the remaining amount of paper sheets detected by the remaining amount detecting portion 502, based on the correction amount, wherein the correction amount is obtained when the correspondence relation between: the amount of paper bundle P placed on the lifting/lowering plate 201; and whether or not a warpage occurs to the lifting/lowering plate 201, is obtained. Although not limited in particular, in the present embodiment, the remaining amount correcting portion 503 holds a correction table in which detection results of the remaining amount detecting portion 502 and correction output values are recorded in correspondence with each other, wherein the correction output values are output when the determination portion 501 determines that the lifting/lowering plate 201 has a warpage.

FIG. 7 is a diagram showing an example of the correction table. The example shown in FIG. 7 indicates the case where the determination portion 501 determines that there is a warpage when the "remaining amount detection value" by the remaining amount detecting portion 502 is "20%", "30%", or "40%" of the maximum capacity (maximum mounting capacity) of paper sheets P. In this example, it is registered that when the "remaining amount detection value" by the remaining amount detecting portion 502 is "20%", "30%", and "40%", output values "10%", "20%", and "30%" are output from the remaining amount correcting portion 503, respectively. It is noted that when the "remaining amount detection value" is "0%", "10%", or any of "50%" through "100%", the determination portion 501 determines that no warpage has occurred to the lifting/lowering plate 201, and thus the remaining amount correcting portion 503 does not correct the remaining amount of paper sheets. As a result, these values need not be registered in the remaining amount detecting portion 502. Here, however, these values are contained in the table for the sake of explanation.

Here, the remaining amount correcting portion 503 performs corrections such that when the "remaining amount detection value" by the remaining amount detecting portion 502 is "20%", "30%", or "40%", it uniformly reduces the paper sheet remaining amount by "10%". However, the correction amount may not necessarily be uniform. For example, it is possible to adopt a configuration where the correction amount is reduced as the remaining amount detection value approaches the upper limit or lower limit of the correction target range, and is increased when the remaining amount detection value belongs to an intermediate area of the correction target range. In addition, the lifting/lowering plate 201, which is a member made of resin, may vary in the level of warpage depending on the ambient temperature. As a result, it is possible to adopt a configuration where a temperature measuring means is disposed in the multifunction peripheral 100, and a determination standard and/or a correction amount is varied based on the temperature measured by the temperature measuring means, wherein the determination standard is used by the determination portion 501 to determine whether or not the lifting/lowering plate 201 has a warpage, and the correction amount is the amount of correction performed by the remaining amount correcting portion 503.

Furthermore, the multifunction peripheral 100 of the present embodiment includes a notification portion 511. The notification portion 511 notifies the user of the paper sheet remaining amount by an arbitrary method. For example, to notify this, the paper sheet remaining amount may be displayed on a display of the operation panel 171.

Figure 8:
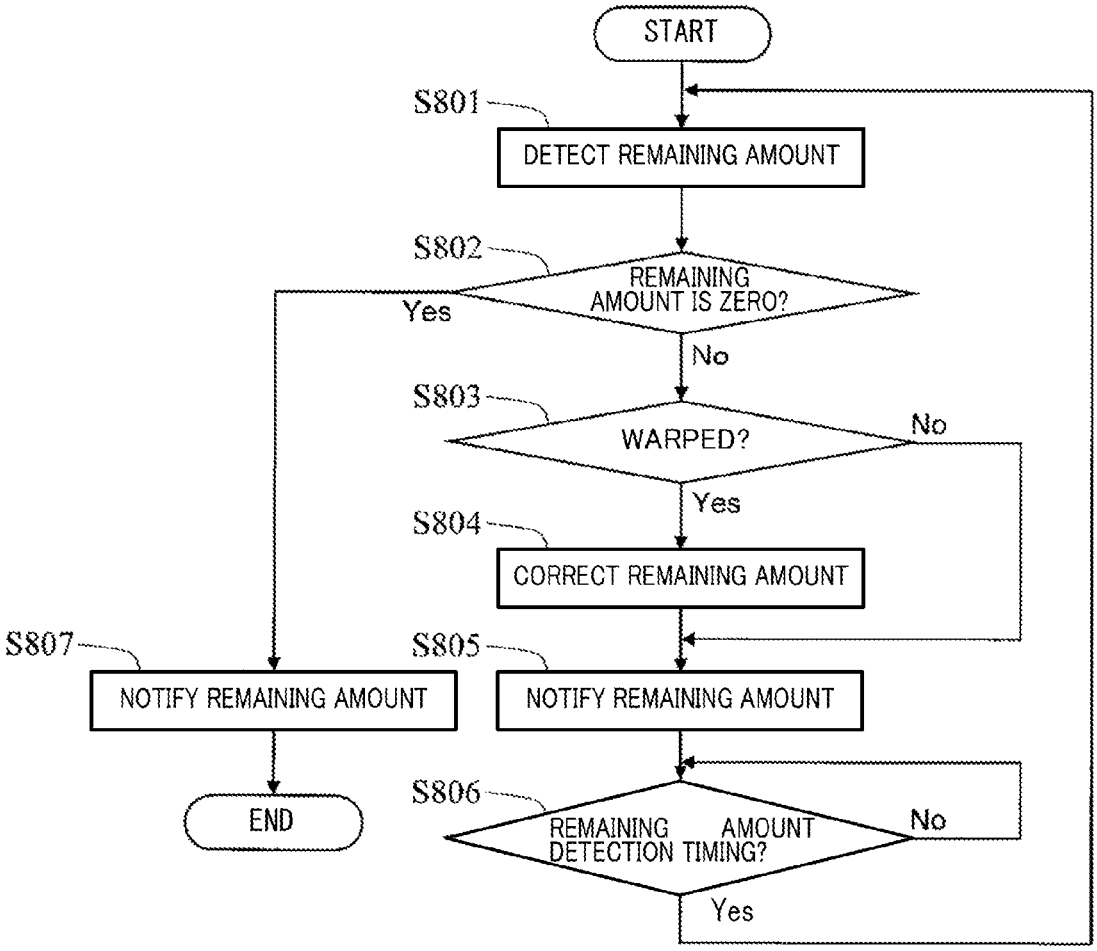
FIG. 8 is a flow diagram showing an example of the remaining amount correction procedure executed by the multifunction peripheral in an embodiment of the present disclosure.

FIG. 8 is a flow diagram showing an example of the remaining amount correction procedure executed by the multifunction peripheral 100. This procedure is started, for example, when the main power source of the multifunction peripheral 100 is turned on, or when the paper-sheet feed apparatuses 152, 153 are attached to the multifunction peripheral 100. It is noted that this procedure is executed for each of the paper-sheet feed apparatuses 152, 153.

With the start of the procedure, the remaining amount detecting portion 502 obtains, by the above-described method, the amount of paper sheets placed on the lifting/lowering plate 201 (step S801). The remaining amount detecting portion 502 sends a notification of the obtained paper sheet amount to the determination portion 501.

Upon receiving the notification, the determination portion 501 determines whether or not the paper sheet remaining amount is zero (step S802). When the paper sheet remaining amount is zero, the determination portion 501 causes the notification portion 511 to notify thereof (step S802 Yes, S807). This ends the procedure.

When the paper sheet remaining amount is not zero, the determination portion 501 determines, based on the notified paper sheet amount, whether or not the lifting/lowering plate 201 has a warpage (step S802 No, S803). When it determines by the above-described method that the lifting/lowering plate 201 does not have a warpage, the determination portion 501 sends a notification of this to the notification portion 511 (step S803 No). Upon receiving the notification, the notification portion 511 obtains, from the remaining amount detecting portion 502, the paper sheet amount detected by the remaining amount detecting portion 502, and displays the paper sheet amount on the display of the operation panel 171 (step S805).

When it determines that the lifting/lowering plate 201 has a warpage, the determination portion 501 sends a notification of this to the remaining amount correcting portion 503 (step S803 Yes). Upon receiving the notification, the remaining amount correcting portion 503 identifies a correction value as the correction paper sheet amount based on the correction table registered in the remaining amount correcting portion 503 itself, and inputs the correction value to the notification portion 511 (step S804). In this case, the notification portion 511 displays the input correction paper sheet amount on the display of the operation panel 171 (step S805).

The procedure described above is repeatedly executed each time the remaining amount detection timing comes (step S806 No, S806 Yes). The remaining amount detection timing may be set as a predetermined time interval during an execution of a job, such as a print job or a facsimile reception job, that uses paper sheets, or a predetermined time interval during waiting, or the like.

As described above, in the multifunction peripheral 100, when a warpage has occurred to the lifting/lowering plate 201, the remaining amount detection value is corrected, wherein the remaining amount detection value indicates the remaining amount of paper sheets detected by the remaining amount detecting portion 502. With this configuration, even in the state where a warpage may occur to the lifting/lowering plate 201 due to adoption of the lifting/lowering plate 201 made of resin, it is possible to notify the user of a correct paper sheet remaining amount. In addition, with the configuration of the above-described embodiment where the determination portion 501 determines whether or not the lifting/lowering plate 201 has a warpage, based on the amount of paper sheets placed on the lifting/lowering plate 201, it is possible to realize it by software. Accordingly, it is possible to realize it with a low cost.

It is noted that the above-described embodiment does not limit the technical scope of the present disclosure, and various modifications and applications, other than those having already been described, are possible within the scope of the present disclosure. For example, an arbitrary method may be used to determine whether or not the lifting/lowering plate 201 has a warpage, and an arbitrary configuration may be adopted in the mechanism for detecting the paper sheet remaining amount. For example, in the above-described embodiment, an example case of detecting a paper sheet remaining amount larger than the actual paper sheet remaining amount due to the warpage of the lifting/lowering plate 201 is explained. However, depending on the paper sheet remaining amount detection method, a case of detecting a paper sheet remaining amount smaller than the actual paper sheet remaining amount due to the warpage of the lifting/lowering plate 201 might be considered. In that case, the remaining amount correcting portion 503 might correct the difference between the actual paper sheet remaining amount and the smaller amount.

The correction table shown in FIG. 7 is only an example. The amount of paper bundle P with which a warpage tends to easily occur to the lifting/lowering plate may be different from that in the example shown in FIG. 7. In that case, the correction table may be set as appropriate based on the range of the amount of paper bundle P with which a warpage occurs.

Furthermore, with regard to the flowchart shown in FIG. 8, the order of the steps or the like may be varied as appropriate within the range in which an equivalent act is produced.

In addition, in the above-described embodiment, the present disclosure is embodied as a sheet feed apparatus of a digital multifunction peripheral. However, not limited to the digital multifunction peripheral, the present disclosure may be applied to a sheet feed apparatus of an arbitrary image forming apparatus, such as a printer, a copier or the like, that has a printing function. Furthermore, not limited to paper sheets, the present disclosure may be applied to a sheet feed apparatus that conveys arbitrary sheets.

The present disclosure makes it possible to prevent occurrence of an erroneous detection of the sheet remaining amount due to a warpage of the lifting/lowering plate, and is useful as a sheet feed apparatus and an image forming apparatus.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet feed apparatus comprising:

a lifting/lowering plate having a sheet mounting surface on which one or more sheets are placed, and being attached in such a manner that the sheet mounting surface can be lifted and lowered, the lifting/lowering plate being made of a flexible material;

a drive portion configured to lift and lower the lifting/lowering plate;

a determination portion configured to determine whether or not the lifting/lowering plate has a warpage;

a remaining amount detecting portion configured to detect a remaining amount detection value which indicates a remaining amount of sheets placed on the sheet mounting surface; and a remaining amount correcting portion configured to correct the remaining amount detection value detected by the remaining amount detecting portion, based on a determination result of the determination portion.

2. The sheet feed apparatus according to claim 1, wherein the determination portion determines whether or not the lifting/lowering plate has a warpage, based on an amount of sheets placed on the sheet mounting surface.

3. An image forming apparatus comprising the sheet feed apparatus according to claim 1.

* * * * *